United States Patent [19]

Morris

[11] Patent Number: 4,673,536

[45] Date of Patent: Jun. 16, 1987

[54] FUEL ADMIXTURE DEVICE

[76] Inventor: George Q. Morris, 3563 N. Quarzo Cir., Thousand Oaks, Calif. 91362

[21] Appl. No.: 664,936

[22] Filed: Oct. 25, 1984

Related U.S. Application Data

[63] Continuation-in-part of Ser. No. 466,774, Feb. 15, 1983, abandoned.

[51] Int. Cl.[4] ..... F02M 19/08

[52] U.S. Cl. ..... 261/78.1; 261/DIG. 39; 261/DIG. 12

[58] Field of Search ..... 261/DIG. 39, DIG. 12, 261/78.1

[56] References Cited

U.S. PATENT DOCUMENTS

| | | | |
|---|---|---|---|
| 1,381,253 | 6/1921 | Thomasson | 261/DIG. 12 |
| 1,493,894 | 5/1924 | Reece | 261/44 A |
| 1,623,347 | 4/1927 | Kelley et al. | 261/78 R |
| 1,625,867 | 4/1927 | Plant | 261/78 R |
| 1,818,068 | 8/1931 | Kreher | 261/18 R |
| 1,857,070 | 5/1932 | Thomas | 261/79 R |
| 1,889,687 | 11/1932 | Mennesson | 261/DIG. 39 |
| 2,007,337 | 7/1935 | Mallory | 261/44 A |
| 2,011,997 | 8/1935 | Cameron | 261/79 R |
| 2,016,449 | 10/1935 | Moysard | 261/79 R |
| 2,034,990 | 5/1936 | Gustafsson | 261/18 B |
| 2,991,052 | 7/1961 | Carlson et al. | 261/DIG. 39 |
| 3,275,308 | 9/1966 | Thomas | 261/78 R |
| 3,472,495 | 10/1969 | Marsee et al. | 261/DIG. 39 |
| 3,648,988 | 3/1972 | Dibert | 261/DIG. 39 |
| 3,664,648 | 5/1972 | Seeley, Jr. | 261/DIG. 39 |
| 3,715,108 | 2/1973 | Denton | 261/50 A |
| 3,834,678 | 9/1974 | Baribeau et al. | 261/78 R |
| 3,883,622 | 5/1975 | Woods | 261/DIG. 39 |
| 4,105,003 | 8/1978 | Funk | 261/DIG. 39 |
| 4,132,752 | 1/1979 | Petermann | 261/DIG. 39 |
| 4,375,438 | 3/1983 | McKay | 261/DIG. 39 |

FOREIGN PATENT DOCUMENTS

| | | | |
|---|---|---|---|
| 396593 | 6/1924 | Fed. Rep. of Germany | 261/DIG. 39 |

*Primary Examiner*—Tim Miles

*Attorney, Agent, or Firm*—Richard D. Slehofer

[57] ABSTRACT

A fuel to air admixture venturi nozzle having peripheral fuel distribution. A fixed air inlet having a convergent-divergent configuration has a booster cylinder disposed proximate the most narrow portion thereof. A peripheral venturi having a convergent-divergent cross-section is formed by cooperation of the booster cylinder with the walls of the air inlet. Fuel is delivered to the air inlet at the most narrow part of the peripheral venturi, achieving improved fuel atomization and distribution.

3 Claims, 10 Drawing Figures

FUEL ADMIXTURE DEVICE

This is a continuation-in-part of application Ser. No. 466,774, filed Feb. 15, 1983, now abandoned.

BACKGROUND OF THE INVENTION

It is well known in the art of fuel supply to internal combustion engines that finer atomization and more even fuel distribution into the intake air result in lower specific fuel consumption, especially in multi-cylinder engines. With conventional carburetors, fuel atomization and distribution at larger engine loads is often much less than optimal. The typical carburetor employs a butterfly-type throttle valve for flow modulation, and has a large load fuel to air admixture nozzle that consists of a fuel outlet located in the inlet airstream centrally in a venturi constriction portion of the inlet.

For large load but less than full load engine operating conditions, the throttle valve is at a steep angle in the air inlet. Air flowing through the inlet upstream from the throttle must divide to flow past the partially open throttle. The lateral air movement in the air inlet to achieve this division occurs more upstream in the inlet the closer the air is to the inlet periphery. Air flowing in the center of the inlet airstream does not undergo lateral movement until just immediately above the throttle plate.

Centrally located large load fuel outlets are typically constrained by physical size to be as compact as possible. Thus, they are often at a disadvantage in their ability to involve a large mass of air at the contact point of fuel to air admixture. The resulting poor atomization means that there are large fuel droplets that are entrained in the center part of the inlet flow. As previously mentioned, the flow in the center part of the inlet does not divide for partial throttle operation until immediately above the angled throttle plate. The result of this is that majority of the entrained fuel escapes symmetrical lateral flow action, but is instead influenced by the slant of the partially open throttle plate. As a consequence, the majority of the entrained fuel is directed towards the downstream angled part of the throttle plate Thus, the fuel distribution downstream from the throttle plate is less than optimal, there being a strong biasing of the fuel towards one side of the air inlet.

A few previous attempts to overcome some of these problems had a main fuel nozzle which introduced the large load fuel into the air inlet through a series of outlet holes or ports equally spaced about the periphery of the air inlet, at or just below the venturi constriction. This theoretically can entrain the fuel in the peripheral airflow in the inlet, where there is the soonest and greatest lateral flow near the partially open throttle, hence the least biasing effect due to the throttle plate angle.

These previous attempts did not meet with much success, however, for several reasons. One is that fuel atomization was not very good, due partially to the stagnant layer of air near the intake walls. Although admixture mass was large, air speed was low. Also, fuel flow out of the outlet ports nearest the supply duct tended to be much greater than fuel flow from the outlet ports most remote from the supply. This resulted in a very unfavorable bias at or near wide open throttle. Also, locating the peripheral ports around the most narrow part of the conventional venturi constriction did not ensure that the ports would all open into the minimum pressure area, or that the pressure reduction at all of the port openings would be the same. These inconsistencies exerted an adverse effect on fuel metering and distribution.

In comparison with previous peripheral constructions, a conventional centrally located compound venturi booster nozzle, with its very high air speed, gave better overall results.

Additionally, the present invention provides a fuel to air admixture construction which acts to minimize or prevent altogether the tendency for fuel to leave the fuel/air mixture and be deposited onto the air inlet walls. The divergent configuration of the walls of the air inlet causes the fuel to move relatively away from the inlet walls while flowing through the air inlet.

The present invention provides a peripheral main fuel nozzle which overcomes the problems of previous designs, thereby affording the advantages of large air mass at the point of admixture, fuel entrainment in the peripheral airflow, and the additional advantage of very high air speed at the point of admixture. Furthermore, the smaller dimensions of the peripheral venturi provide more consistent and reliable pressure reduction signal for the main fuel metering means.

The carburetor of the present invention is simple and easy to construct, employing to advantage the manufacturing techniques and tooling currently used to manufacture carburetors. The design even lends itself well to retrofitting carburetors already manufactured or in service.

SUMMARY OF THE INVENTION

The present invention provides a peripheral main fuel nozzle and venturi construction which is capable of excellent fuel atomization and distribution, especially when employed in conjunction with a carburetor utilizing a butterfly type throttle blade.

In the present invention, a carburetor has an air inlet with a venturi constriction. A booster cylinder is disposed in the air inlet proximate the venturi construction such that a peripheral venturi is formed between the inlet wall and the booster cylinder. Disposed annularly about the inlet wall at the greatest constriction of the peripheral venturi is a fuel supply channel having fuel outlet ports opening into the peripheral venturi at its point of greatest constriction. Due to the provision of the perpherial venturi, inlet airspeed at the fuel outlet ports is greatly increased, resulting in improved fuel atomization. The mass of air that can be involved at the point of admixture is increased. Fuel mixed with air flows in the air inlet around its periphery. Because of this, fuel flows essentially symmetrically around a partially open butterfly type throttle blade. An annular fuel distribution channel can be provided to control fuel flow to the supply channel such that fuel flow from the outlet ports is more symmetrical with respect to the air inlet.

Fuel flow into the peripheral venturi can also be achieved by locating the fuel outlet ports in the booster cylinder, thus further reducing the possibility of fuel separation onto the air inlet walls.

Other advantages and novel features of the invention will become apparent from the following detailed description when considered in conjunction with the accompanying drawings, wherein like reference numerals refer to like parts throughout.

DETAILED DESCRIPTION OF THE PREFERRED EMBODIMENTS

Figure 1:
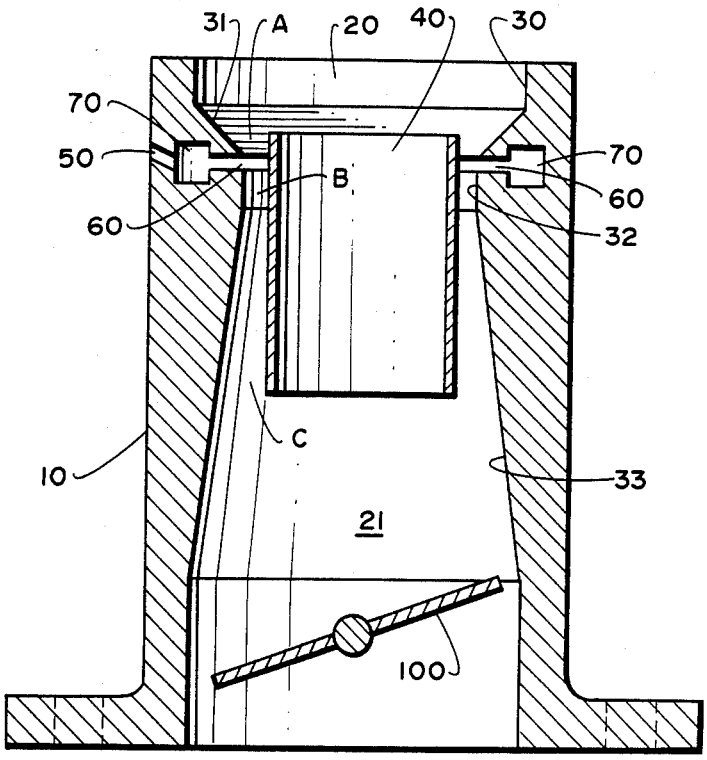
FIG. 1 is a cross-sectional view of one embodiment of the present invention.

FIG. 1 illustrates a basic embodiment of the present invention. Generally indicated at 10 is a carburetor body or air inlet body defining an air inlet conduit shown at 20. The conduit supplies air to an internal combustion engine. The conduit 20 is bound by wall portions 30, 31, 32, and 33. The inlet conduit 20 has a first convergent, then divergent configuration so that a venturi constriction is formed thereby. The upstream part of conduit 20 is bound by the wall portion 30 so that the walls are essentially parallel or non-convergent. The wall portion at 31 converges so that the air inlet cross-section becomes smaller in the direction of airflow. The inlet region bounded by the wall portion at 32 is the most narrow part of the air inlet, and is the venturi constriction region. The wall portion at 33 gives the air inlet a divergent cross-section in this region so that the speed of the inlet air flowing through the most narrow part of the air inlet is recovered as kinetic energy. Shown generally at 21 is the downstream region of the air inlet.

Disposed in the air inlet 20 is booster cylinder 40. The cylinder 40 is located in the inlet 20 such that the axis of the cylinder 40 is essentially coaxial with the axis of the inlet 20. The upstream end of the cylinder 40 is located somewhat upstream from the most narrow part of the inlet 20, and the downstream end of the cylinder 40 is located downstream from the most narrow part of the air inlet 20. The diameter of the cylinder 40 is such that the outside walls of the cylinder 40 are in proximity to the walls of inlet 20. This proximity defines a cylindrical channel having a first convergent, then divergent cross-section, and this cylindrical channel so defined shall be referred to herein as the peripheral venturi. The convergent or upstream end of this peripheral venturi is indicated at A. The most narrow part of the peripheral venturi is indicated at B. The divergent or downstream part of the peripheral venturi is indicated at C. The region A is defined between the outside wall of 40 and the inlet wall portion 31. The region B is defined between the outside wall of 40 and the inlet wall portion 32. The region C is defined between the outside wall of 40 and the inlet wall portion 33. A fuel supply channel, shown at 70, is disposed essentially annularly about the air inlet 20. A fuel supply duct 50 provides fuel to the supply channel 70 from a metering means (not shown) which may be any fuel metering means. Fuel outlet port 60 connects the fuel supply channel 70 to the peripheral venturi in the region B. The fuel outlet port 60 is an essentially continuous slot, disposed annularly about the peripheral venturi.

In operation, the internal combustion engine, which is supplied with a fuel/air mixture through the invention, draws air through the air inlet conduit 20. Some of this air flows through the hollow interior of the booster cylinder 40, the remainder of the air flows through the peripheral venturi. As air flows through the convergent region A of the peripheral venturi it is accelerated to a high speed. This high speed results in a strong pressure reduction metering signal. This pressure reduction is applied to the fuel metering means through the port 60, supply channel 70, and the fuel duct 50, since the port 60 opens into the peripheral venturi at region B. In response to this pressure reduction, fuel flows through duct 50, into channel 70, and out the port 60 into the air flowing through region B. Since the airflow in region B is at high speed, the fuel is well atomized. The air mixed with fuel then flows through region C, where the mixture is slowed and its absolute pressure increases. The fuel and air then flow to the internal combustion engine. All of, or the substantial majority of, the total required fuel for the engine that is introduced into the air inlet upstream of the throttle is flowed into the peripheral venturi in this manner.

Figure 2:
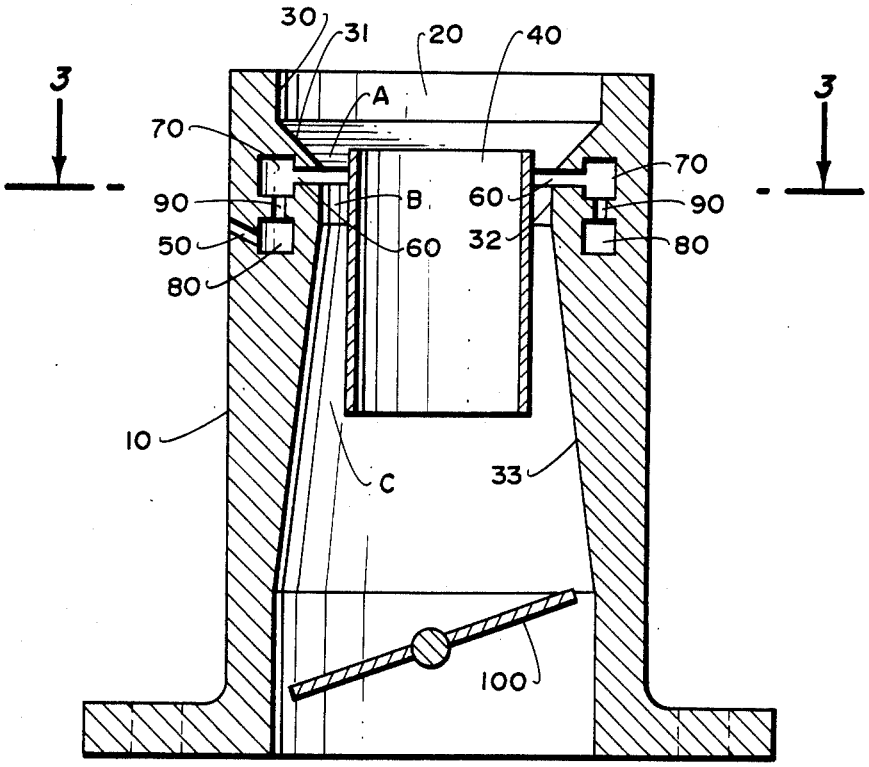
FIG. 2 is a cross-sectional view illustrating an embodiment having a fuel distribution channel.

FIG. 2 illustrates an embodiment of the invention wherein fuel distribution symmetry is enhanced through provision of an additional fuel channel. In the embodiment of FIG. 2, fuel is supplied to the invention from a metering means (not shown) through the fuel duct 50. Fuel from duct 50 flows into a distribution channel shown at 80. Channel 80 is preferably disposed annularly about the air inlet 20. Fuel supply channel 70 is disposed annularly about the air inlet 20. The supply channel 70 opens into the most narrow part of the peripheral venturi through outlet ports 60, as previously described. Channel 80 is connected to channel 70 through transfer channels 90. The transfer channels 90 have locations and flow capacities such that fuel is distributed into the channel 70 in such a way that fuel flow out of the ports 60 results in symmetrical distribution of the fuel into the inlet air flowing through the conduit 20.

The provision of the distribution channel 80 and the transfer channels 90 overcomes the tendency for more fuel to flow out of the part of port 60 which is nearest the fuel duct 50.

In reference to FIG. 2, many of the advantageous features of the invention can be appreciated.

In conventional air inlets with butterfly-type throttles, the fuel is introduced centrally into the inlet air and becomes severely biased when flowing past the partially open throttle blade. This bias tends to cause the great majority of the fuel to flow around the downstream moving throttle blade edge, resulting in very unfavorable fuel mixture homogeneity downstream from the throttle, where the mixture is prepared for delivery to the cylinders.

In the present invention, the fuel is mixed with the air towards the outside of the inlet, rather than the center. The fuel is evenly distributed into the air due to the action of the peripherally located fuel outlet ports 60 supplied symmetrically with fuel through the fuel distribution and supply channels 80 and 70. Thus, when the fuel/air mixture reaches the vicinity of the partially open throttle, the mixture flows evenly past both the upstream and downstream blade edges. This avoids the unfavorable mixture biasing inherent conventional designs.

Also, in the present invention, the mass of air available at the region of fuel/air admixture is much larger than with most conventional venturi nozzle designs. This is due to the fact that the ports 60 are located along the relatively large dimension of the periphery of the inlet, rather than along the relatively small dimension of a small port or circle in the center of the air inlet.

Furthermore, the peripheral venturi provides a venturi constriction having much smaller physical dimensions than conventional venturi constrictions where the operating venturi is formed by the whole of the air inlet cross section. In such conventional types, there is a serious degree of inconsistency in the exact physical location of the point of lowest pressure versus the geometrical location of the vena contracta. There are also severe effects due to any air flow obstructions in the air inlet upstream from the venturi.

In these cases, nozzle locations that are assembled using practical manufacturing techniques often result in serious irregularities in carburetor metering, with consequent inefficiencies in engine operation. The present invention, with its relatively narrow vena contracta, permits excellent consistency in metering signal strength utilizing simple manufacturing techniques.

Also, depending on the proximity of the booster nozzle to the air inlet walls, the present peripheral venturi permits venturi constructions having greater cross sectional ratios, hence greater signal strengths and higher admixture airspeed, than conventional designs using the same length air inlet.

Figure 3:
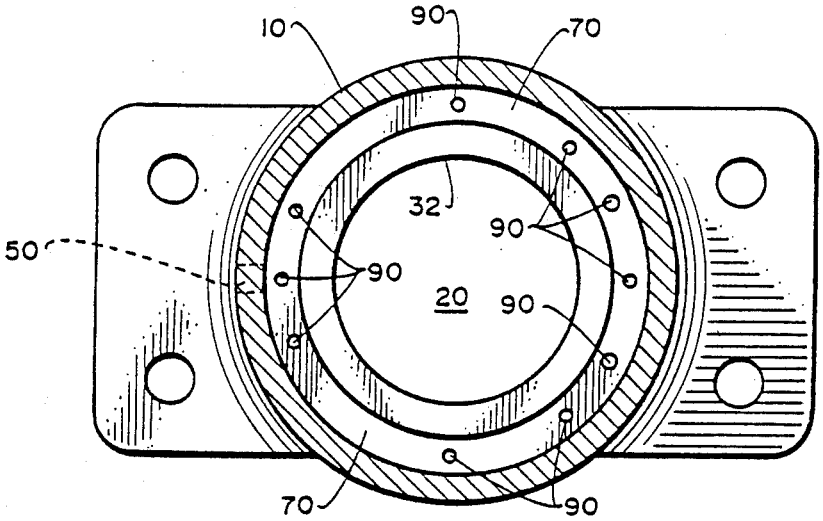
FIG. 3 is a top view of the embodiment of FIG. 2, taken along the line 3—3.

FIG. 3 more clearly illustrates the channels 80 and 90. FIG. 3 is taken along the line 3—3 of FIG. 2. Shown more clearly are the plurality of channels 90 as they communicate into the channel 70. Note that the channels 90 are not all of the same size or flowing capacity, and that they may be, and in fact are preferably, asymmetrically located about the channel 70. This permits fuel to be asymmetrically delivered into the channel 70 to compensate for the natural asymmetry that occurs when fuel is provided through the fuel duct 50. FIG. 3 illustrates how more of the channels 90 are located in the channel 70 on the opposite side from the duct 50.

Figure 4:
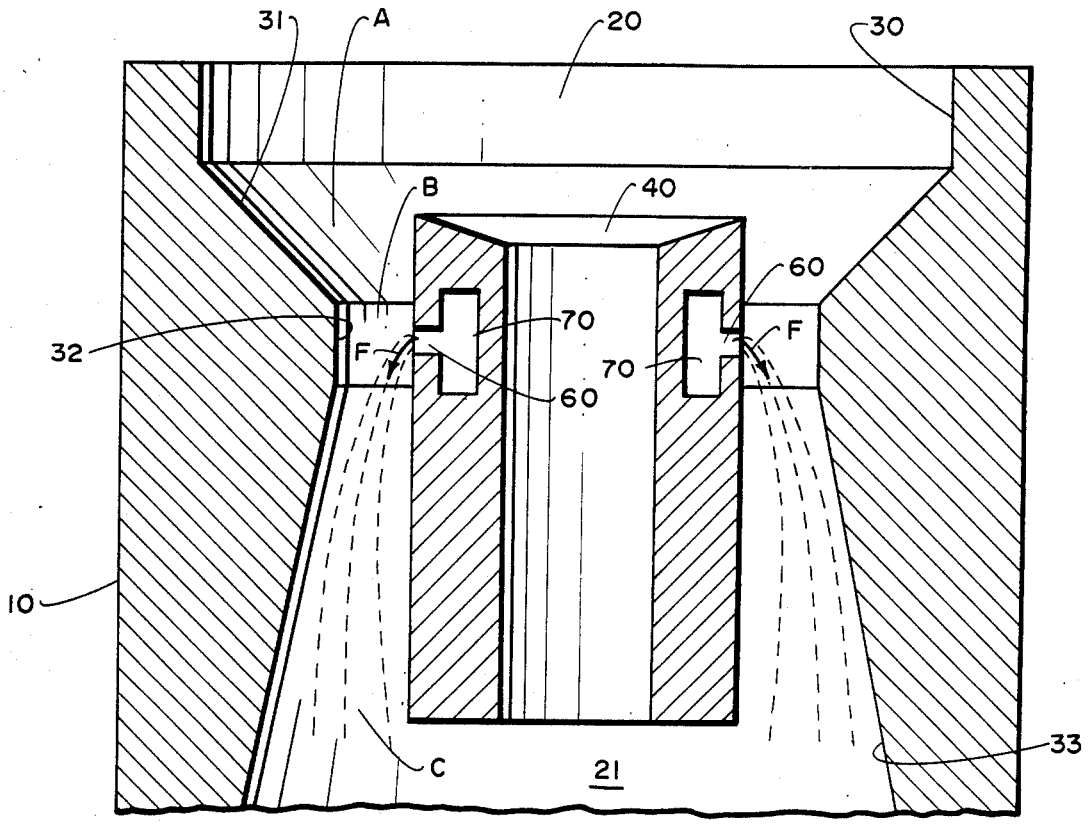
FIG. 4 is a cross-sectional view illustrating fuel flow in the peripheral venturi.

FIG. 4 illustrates the region of fuel to air admixture. The fuel exits the ports 60 into the airstream in the region of the most constricted portion of the peripheral venturi. The fuel moves laterally out of the ports 60, and is then carried downstream in the peripheral venturi. The path of the fuel is illustrated by the arrow F. As is clearly seen, the fuel maintains some of its lateral motion even after entering the airstream. The divergent configuration of the air inlet walls at the region downstream from the ports results in these walls moving relatively away from the entrant fuel droplets so as to reduce the tendency for the fuel to otherwise approach the walls as a result of the lateral movement.

Figure 5:
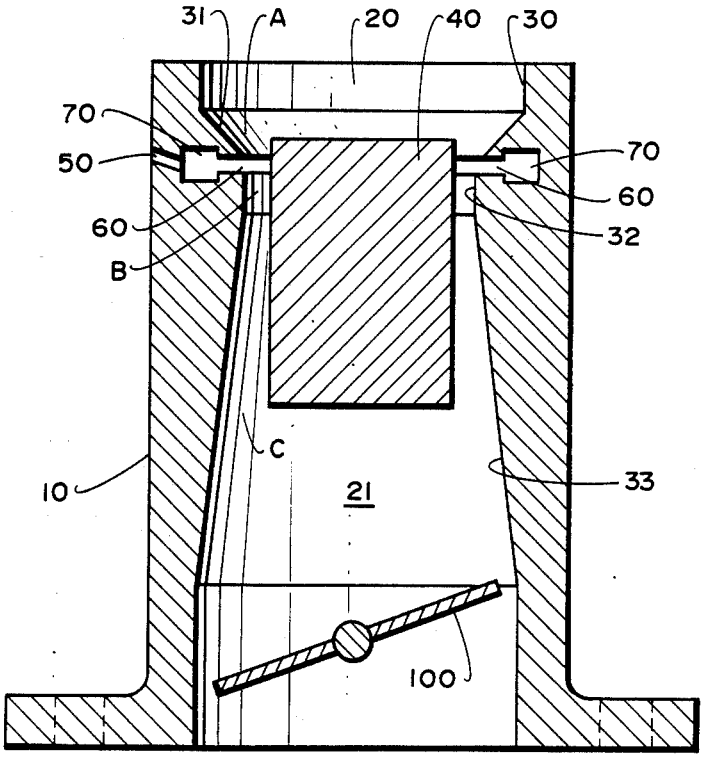
FIG. 5 is a cross-sectional view of one embodiment of the present invention having a solid booster cylinder.

FIG. 5 illustrates an embodiment of the present invention wherein the booster cylinder 40 is of solid construction such that inlet air flowing through the inlet 20 essentially all flows through the peripheral venturi region A, B, C. This configuration of the booster cylinder provides a very restricted air inlet with resulting high speed airflow for improved fuel atomization.

Figure 6:
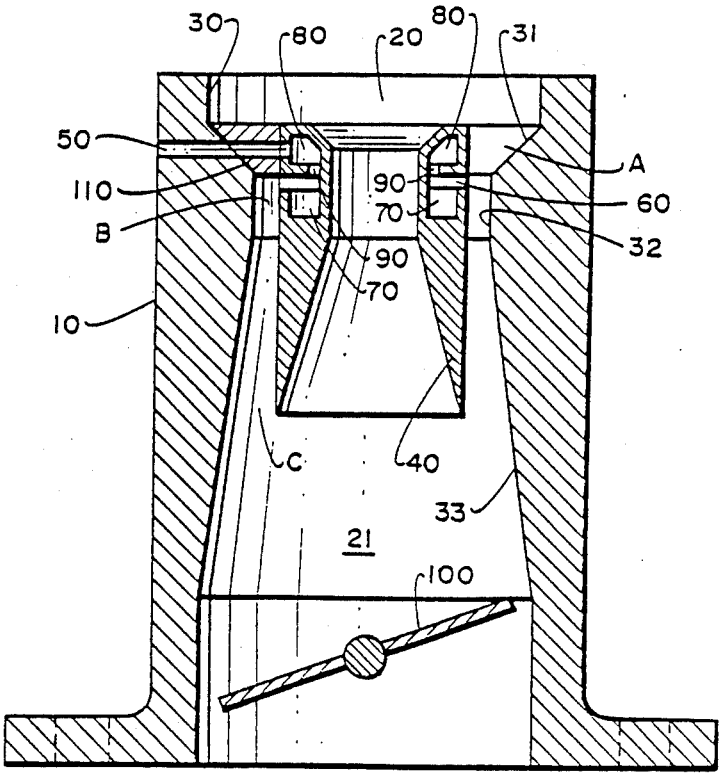
FIG. 6 is a cross-sectional view of one embodiment of the invention wherein the fuel outlet ports are contained in the booster cylinder.

FIG. 6 illustrates an embodiment of the present invention wherein the supply and distribution channels and fuel outlet ports are located in the booster cylinder. In the embodiment of FIG. 6, the booster cylinder 40 forms a peripheral venturi as previously described. The cylinder itself is constructed with some thickness, so that the fuel distribution channel 80, fuel supply channel 70, and transfer channels 90 can be located and function properly in the booster cylinder. The fuel outlet ports 60 open into the peripheral venturi from the outside of the booster cylinder. The fuel duct 50 passes through a structural member 110 which positions the booster cylinder properly in the air inlet.

Figure 7:
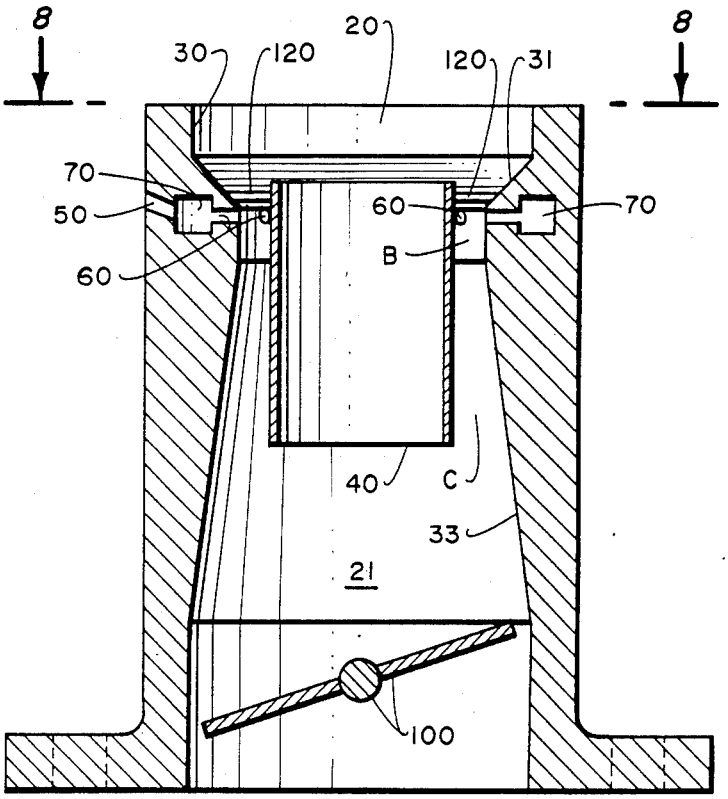
FIG. 7 is a cross-sectional view of one embodiment of the invention having radially located turbulence bars.

The embodiment of FIG. 7 illustrates an enhancement which improves fuel atomization at the region of admixture in the peripheral venturi. In FIG. 7, a plurality of turbulence bars 120 are located at the juncture of regions A and B in the peripheral venturi. These bars 120 extend radially outward from the booster cylinder 40. Air flowing through the peripheral venturi flows past the bars 120, resulting in severe regions of turbulence downstream from the bars 120. Fuel flowing out the ports 60 flows into these turbulence regions and is finely atomized. In the FIG. 7, the ports 60 are configured as holes rather than the slot previously illustrated. These holes 60 preferably open into the peripheral venturi so as to direct their fuel output into the turbulance region downstream from each bar 120. There may preferably be one port 60 situated with an associated atomization bar such that the fuel issuing form the port flows immediately into the stagnant region of flow that is immediately downstream from each of the turbulence bars.

Figure 8:
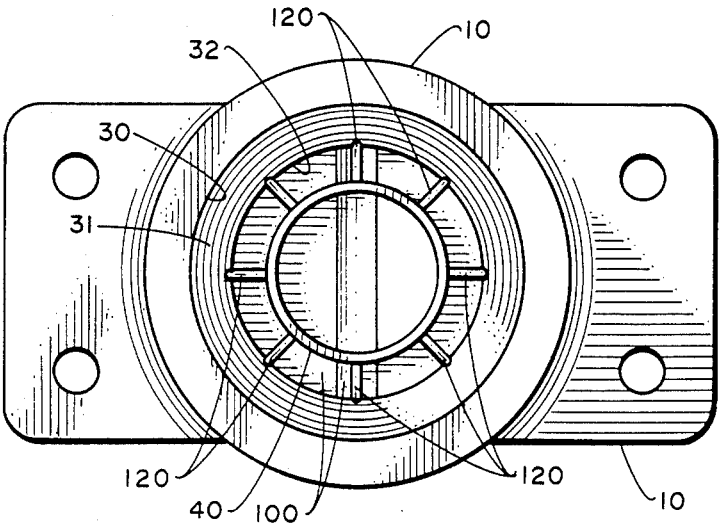
FIG. 8 is a top view of the embodiment of FIG. 7 taken along the line 8—8.

FIG. 8 is a top view of FIG. 7 taken along the line 8—8, and more clearly illustrates the turbulence bars 120.

It should be noted that the turbulence bars need not be connected both to the booster cylinder and the walls of the air inlet. A gap between a bar and the booster cylinder or between a bar and the inlet wall can be employed to advantage to allow an air flow which will inhibit fuel separation onto the surface of the booster cylinder or inlet wall.

Figure 9:
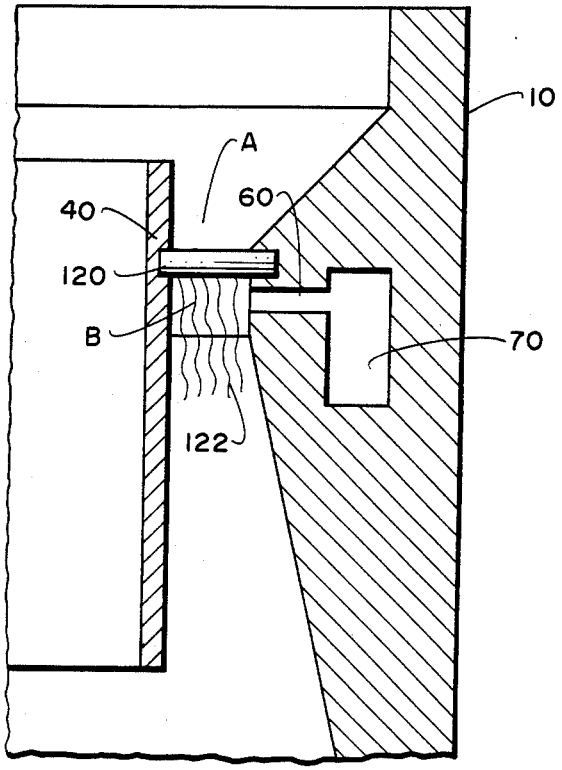
FIG. 9 is a cross-sectional view of the air inlet in the region of an atomization bar, illustrating its action.

FIG. 9 illustrates the action of the turbulence bars. In FIG. 9, the turbulence bar 120 is located in the peripheral venturi near the junction of the regions A and B. As air flows through the peripheral venturi, a stagnant region of air forms immediately downstream from the bar 120. This stagnant region is shown at 122. In the region 122 there are numberous swirls and counter-flow eddy regions which aid in breaking up fuel droplets and atomizing the fuel. Thus, fuel is introduced into the peripheral venturi airflow through the ports 60 which are preferably located immediately downstream from the bars 120. Some of this fuel will be drawn into the regions 122 by the counterflow effect. The fuel will be efficiently atomized by the turbulence effects as previously described. A further advantage of the turbulence bars is that the total mass of air available for fuel atomization is increased due to the increased admixture boundary defined by the bars.

It should be noted that the air inlet conduit configuration of the present invention requires an air inlet having outer walls that form a first convergent, then divergent configuration, and that the booster cylinder is advantageously an essentially true cylinder. This provides a peripheral venturi configuration where there is significant diffuser (pressure recovery) action, yet where the outer inlet walls slope away from the fuel flowing through the air inlet so that fuel contact with the outer walls is prevented or minimized. The inlet is of the fixed or essentially fixed type, that is, where a pressure reduction occurs in response to inlet air flow such that the pressure reduction is essentially proprotional to the quantity of air flowing, and where fuel is metered in response to the pressure reduction.

Also, the booster cylinder is preferably an essentially true cylinder for manufacturing simplicity and air flow consistency. However, it is also contemplated that the booster cylinder may have a conical configuration such that the booster cylinder becomes a progressively smaller in diameter towards the downstream portion of the peripheral venturi. This shape tends to cause a diverging part of the peripheral venturi to diverge at a faster rate, thus potentially affording still further reduction in the possibility of fuel contacting the outer walls of the air inlet. The booster cylinder must not, however, have a conical configuration such that the diameter increases towards the downstream end of the peripheral venturi and such that this conical shape causes fuel to separate out of the mixture onto the booster cylinder. Such separation defeats the advantage of the invention that the fuel be atomized by the high airspeed that occurs in essentially the region of greatest constriction in the peripheral venturi.

The present invention teaches a device wherein a peripheral venturi is formed for improved fuel atomization and for improved fuel distribution. In order to achieve these objects, the booster cylinder must be situated in the air inlet within a certain range of positions so that the booster cylinder cooperates closely enough with the inlet walls to form a true convergent-divergent venturi with significant diffuser action downstream of the most constricted part, and so that the fuel in the fuel-air mixture is truely confined to the peripheral inlet airflow to achieve the fuel distribution advantages as described previously herein. Experiment has shown that these advantages are realized as long as the distance from the outer wall of the booster cylinder to the wall of the air inlet, at the region of closest cooperation of the booster with the air inlet, is about one-third or less of the radius of the air inlet at this region of closest cooperation. Therefore, according to the present invention, the distance from the outer wall of the booster cylinder to the wall of the air inlet, at the region of closest cooperation of the booster with the air inlet wall, is required to be 30% or less of the radius of the air inlet at the region of closest cooperation.

Additionally, the peripheral venturi must have a convergent-divergent configuration with sufficient divergence to form an effective diffuser. Therefore, the booster cylinder must extend a distance downstream from the region of closest cooperation that is equal to or greater that the distance from the outer wall of the booster to the cooperating inlet wall at the region of closest cooperation. This defines a diffuser of sufficient length to achieve the objects of the present invention.

Figure 10:
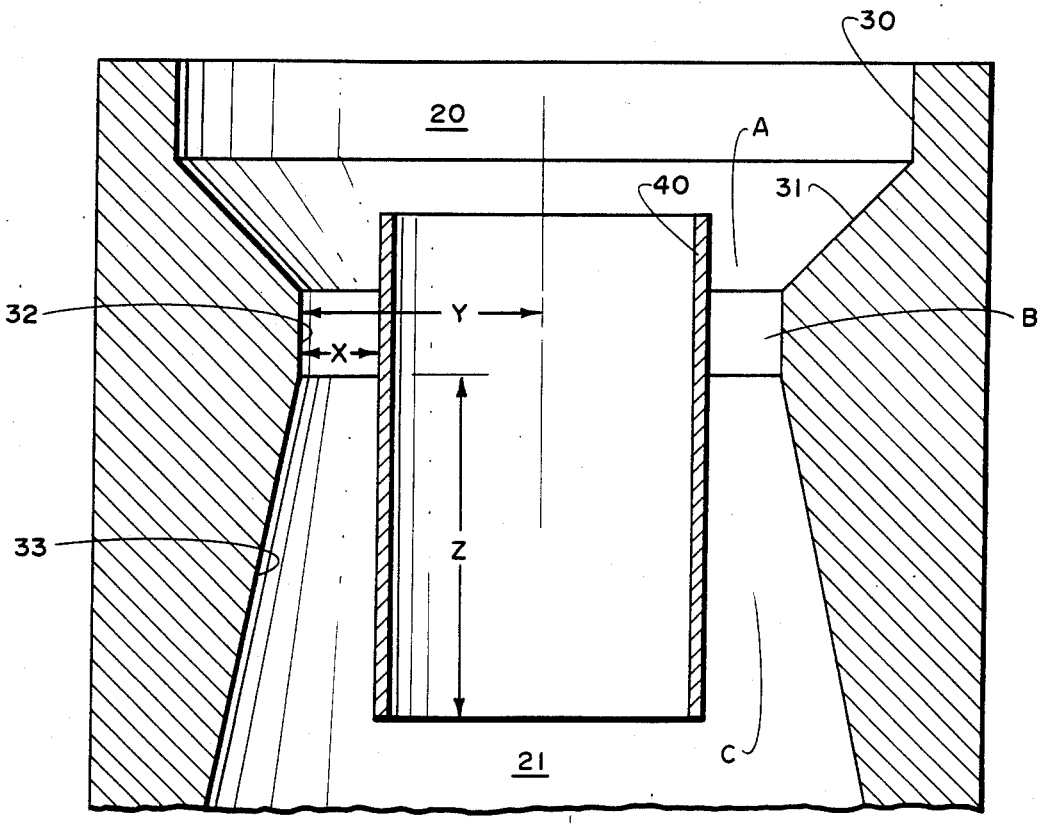
FIG. 10 is a cross-sectional view of the region of cooperation illustrating dimensional relationships.

FIG. 10 illustrates these requirements, where letter X is the distance between the outer wall of the booster cylinder and the wall of the air inlet at the region of closest cooperation, letter Y is the radius of the air inlet at the region of closest cooperation, and letter Z is the distance the booster cylinder extends downstream from the region of closest cooperation.

The various configurations of the booster cylinder described herein have shown the booster cylinder as hollow, with inlet air flowing through the center, or solid, where no air flows through the center. In general, hollow booster cylinders permit a greater maximum air flow through an air inlet with a given dimension. Solid booster cylinders restrict maximum airflow somewhat, but permit more intimate contact of the fuel with the total inlet air mass, and hence provide somewhat more perfect fuel/air mixing.

Another advantage of the construction utilizing the booster cylinder is that the conventional centrally located main fuel nozzle of a conventional carburetor can be easily replaced by a booster cylinder according to the present invention. For instance, the invention shown in FIG. 6 could be illustrating the air inlet of any conventional carburetor where the main fuel nozzle has been substituted for by a booster cylinder of the present invention. The booster cylinder might be solid. In such a case, the fuel duct 50 could pass through member 110 through to the center of the booster, turn downward at the top of the booster, extend down the center of the booster, and communicate to a disk-shaped supply channel which opens directly into the peripheral venturi at region B. Employing such a method, conventional carburetors can easily be converted to the present invention. This would provide highly efficient carburetors at very low manufacturing cost.

Also, the booster cylinders described herein have had axes which are coaxial with the air inlet. It is possible to offset the booster cylinder in the air inlet such that the cylinder axis is parallel to, but not coincident with the inlet axis. This provides a symmetrically varying cross section for the peripheral venturi, and hence a symmetrically varying metering signal around the peripheral venturi, and is useful for correcting flow asymmetry from the fuel outlet ports. To achieve a similar effect, the booster cylinder need not be truely cylindrical, but may be distorted to achieve the variation in cross section and metering signal described above.

Furthermore, the booster cylinders illustrated herein have been shown as essentially straight sections of cylinders. It is possible or even advantageous for some applications to flare the upstream end of the cylinder for improved entry airflow characteristics for the air flowing through the interior of the booster cylinder, or to improve inlet airflow in general.

What is claimed is:

1. An apparatus for mixing fuel and air for supply to an internal combustion engine comprising;

carburetor body means having walls defining air inlet conduit means therein for flowing air to said engine;

said air inlet means having a venturi constriction portion disposed therein formed by configuring said air inlet conduit means to have a first convergent, then divergent cross-sectional configuration in the direction of air flowing through said inlet conduit;

booster cylinder means disposed in said air inlet conduit proximate said venturi constriction portion such that a peripheral venturi is defined between the outside of said booster cylinder and the venturi constriction portion of the walls of said air inlet means;

essentially annular supply channel means disposed about said air inlet conduit means;

essentially annular distribution channel means disposed about said air inlet conduit means;

transfer channel means connected to said supply channel means and connected to said distribution channel means;

fuel supply means connected to said distribution channel means for supplying metered fuel to said supply channel means;

fuel outlet means connected to said supply channel means and connected to said peripheral venturi proximate the most constricted portion thereof;

said fuel outlet means connecting to said peripheral venturi in an annular manner such that fuel flowing from said fuel outlet means into said peripheral venturi means is distributed into air flowing through said peripheral venturi means; and said transfer channel means having predetermined flow capacity and predetermined location of connection to said supply channel means in order to distribute fuel into said supply channel means such that fuel is distributed from said fuel outlet means into said peripheral venturi means in an essentially symmetrical pattern.

2. An apparatus for mixing fuel and air for supply to an internal combustion engine comprising:

carburetor body means having walls defining air inlet conduit means therein for flowing air to said engine;

said air inlet means having a venturi constriction portion disposed therein formed by configuring said air inlet conduit means to have a first convergent, then divergent cross-sectional configuration in the direction of air flow through said inlet conduit;

said air inlet means being of essentially fixed configuration such that a pressure reduction occurs that varies in proportion to the quantity of air that flows through said inlet means;

butterfly type throttle valve means disposed in said air inlet means;

booster cylinder means disposed in said air inlet conduit proximate said venturi constriction portion such that a peripheral venturi is defined between the outside of said booster cylinder and the venturi constriction portion of the walls of said air inlet means;

said peripheral venturi having a region of closest cooperation;

said booster cylinder means disposed in said air inlet conduit such that the distance from said booster cylinder to said walls of said air inlet at said region of closest cooperation is at a maximum 30% of the radius of the air inlet at the region of closest cooperation;

said booster cylinder disposed in said air inlet such that said booster cylinder extends downstream in said air inlet from said region of closest cooperation a distance that is at a minimum equal to the distance from said booster cylinder to said inlet wall at said region of closest cooperation;

essentially annular supply channel means;

fuel outlet means connected to said supply channel means and connected to said peripheral venturi proximate the most constricted portion thereof; and said fuel outlet means connecting to said peripheral venturi in an annular manner such that fuel flowing from said fuel outlet means into said venturi channel means is distributed into said air inlet means about the periphery of said air inlet means.

3. An apparatus for mixing fuel and air for supply to an internal combustion engine comprising:

carburetor body means having walls defining air inlet conduit means therein for flowing air to said engine;

said air inlet means having a venturi constriction portion disposed therein formed by configuring said air inlet conduit means to have a first convergent, then divergent cross-sectional configuration in the direction of air flow through said inlet conduit;

said air inlet means being of essentially fixed configuration such that a pressure reduction occurs that varies in proportion to the quantity of air that flows through said inlet means;

butterfly type throttle valve means disposed in said air inlet means;

booster cylinder means disposed in said air inlet conduit proximate said venturi constriction portion such that a peripheral venturi is defined between the outside of said booster cylinder and the venturi constriction portion of the walls of said air inlet means;

said peripheral venturi having a region of closest cooperation;

said booster cylinder means disposed in said air inlet conduit such that the distance from said booster cylinder to said walls of said air inlet at said region of closest cooperation is at a maximum 30% of the radius of the air inlet at the region of closest cooperation;

said booster cylinder disposed in said air inlet conduit such that said booster cylinder extends downstream in said air inlet from said region of closest cooperation a distance that is at a minimum equal to the distance from said booster cylinder to said inlet wall at said region of closest cooperation;

a plurality of turbulence bars extending across the peripheral venturi proximate the most constricted portion thereof;

said turbulence bars adapted to cause a region of turbulent flow immediately downstream from said bars, said turbulent region extending from adjacent the downstream surface of a bar;

essentially annular supply channel means;

fuel outlet means connected to said supply channel means and connected to said peripheral venturi proximate the most constricted portion thereof;

said fuel outlet means connecting to said peripheral venturi in an annular manner such that a majority of fuel flowing to said engine is delivered into said peripheral venturi; and said fuel being delivered to said peripheral venturi immediately adjacent said turbulence bars downstream from said bars such that fuel flows into said region of turbulent flow downstream from said bars.

* * * * *